United States Patent [19]

Herbert et al.

[11] 4,426,195

[45] Jan. 17, 1984

[54] ADJUSTABLE AXIAL FLOW PISTON MACHINES

[75] Inventors: Karl Herbert, Laudenbach; Gustav Kleineisel, Mainaschaff, both of Fed. Rep. of Germany

[73] Assignee: Linde Aktiengesellschaft, Hollriegelskreuth, Fed. Rep. of Germany

[21] Appl. No.: 296,318

[22] Filed: Aug. 26, 1981

[30] Foreign Application Priority Data

Sep. 16, 1980 [DE] Fed. Rep. of Germany ..... 3034856

[51] Int. Cl.[3] ..... F04B 1/26; F16D 31/02; F15B 9/10; F01B 3/02

[52] U.S. Cl. ..... 417/222; 91/375 R; 91/506; 60/447

[58] Field of Search ..... 417/218, 222, 217; 91/506, 375 R; 60/447

[56] References Cited

U.S. PATENT DOCUMENTS 3,403,628 10/1968 Bobst ..... 417/222
3,406,608 10/1968 Diedrich ..... 91/506
3,877,839 4/1975 Ifield ..... 417/217
4,205,590 6/1980 Stegner ..... 91/506

FOREIGN PATENT DOCUMENTS 2823559 12/1979 Fed. Rep. of Germany .

*Primary Examiner*—William L. Freeh
*Assistant Examiner*—Paul F. Neils
*Attorney, Agent, or Firm*—Buell, Blenko, Ziesenheim & Beck

[57] ABSTRACT

In an adjustable axial flow piston pump having a swivellable component such as a swash plate, pressure chambers for swivelling the swivellable component, a lever connected with the swivellable component and supported in the housing of the pump, a final control member mounted in and movable in the lever, a fluid passage in the lever supplying fluid pressure to the control member, a fluid passage in the pump housing connected to the pressure chamber and a fluid passage in the lever connecting the control member and the fluid passages in the housing whereby fluid pressure is delivered through the lever and control means to the pressure chamber.

12 Claims, 7 Drawing Figures

ADJUSTABLE AXIAL FLOW PISTON MACHINES

This invention relates to adjustable axial flow piston machines and particularly to an axial flow piston pump, with a swivellable component for adjusting the stroke volume per revolution, in particular, a tapered washer (swash plate) axial flow piston machine, in which pressure medium-actuated control pressure chambers, preferably control cylinders, of a servo power control device are provided for swivelling the tapered swash plate, the said chambers being capable of being loaded through a follow-up control arrangement, in particular, a follow-up control arrangement with a square regulation, in which case a lever that is rotatably supported coaxialy to the component that is capable of swivelling for setting the stroke volume and is swivellable arbitrarily or by a control or regulating element is in operating connection with a final control element (pilot) of the servo power control device, in which case this final control element is supported in a control component that is swivellable in common with the swivellable component and, with the final control element, forms the edge control of the follow-up control arrangement. In a familiar tapered swash plate axial flow piston pump of this type, in which the tapered swash plate is formed on an approximately semicylindrical body (rocker), the control component is fastened directly to the rocker and has a borehole in which a valve piston is displaceable and which is connected with the swivellable lever. Control cylinders are provided for swivelling the semicylindrical body and they act on it outside of the swivel axis. The semicylindrical body is pressed into the bearing support of the body by two columns that are connected with this body by flexible joints lying in the swivel axis, in which case the pressure fluid is conveyed to the control cylinders through at least one of these pressing columns through the semicylindrical body to the control component and from the latter in turn through the semicylindrical body to the control cylinders (DE-OS No. 28 23 559.8). In an analogous design of a tapered swash plate pump of the same type, control cylinders that are loaded with pressure fluid through channels in the semicylindrical body are also provided. In this case, however, the edge control of the follow-up control arrangement is provided in the form of a flat slide valve at the sidewall of the semicylindrical body and the fluid is fed through the flat slide valve (DE-OS No. 26 20 524.3). In these designs the control component is thus connected directly with the semicylindrical body or a portion of it. These familiar tapered swash plate pumps have outstandingly proved themselves as technically very good solutions. However, one disadvantage is the high cost of producing the fluid channels in the semicylindrical body and in the first-mentioned familiar design for the pressing columns and their joints.

The invention proposes to reduce the cost of producing the above described familiar solutions while retaining the advantages. This problem is solved according to the invention in that the control component is formed on a lever connected with the swivellable component and supported in a section of the housing of the axial flow piston machine, preferably a portion of this lever is fastened to it, and that the supplying of pressure medium to the edge control of the follow-up control arrangement and the subsequent conveyance of the pressure medium to the control pressure chambers take place through the lever and from it through the housing section in which the lever is supported. All the channels are thus formed either in the lever or in the housing section and can be directed very well from the control pressure pump through the housing to the control pressure chambers supported against the housing. The housing section in which the lever is supported can for example be a cover for the housing. Both such a cover and such a lever are working parts that can be produced as high-quality castings. However, even if normal castings or drop forgings are involved, the production of boreholes for the channels in such small working parts can be effected more simply than in the tapered washer pumps known to date. The bearing support of the lever in the housing section is advantageously designed as a rotary transmission for several fluid pressure channels. If leakage losses occur in this rotary transmission, no great energy loss results because the control pressure medium is under low pressure. On the other hand, the bearing of the lever can be continuously lubricated by such control pressure fluid leaking through at rotary transmission, such that it is always readily workable. In order to form the rotary transmission, the lever can be provided with a cylindrical borehole in which three annular grooves are formed, each of which is connected with one of the three channels in the lever, in which case the lever is supported on a cylindrical extension of the housing section that projects into the borehole and in which three channels empty opposite one of the annular grooves in the housing. Of course, the annular grooves can also be formed outside on the cylindrical extension additionally or instead of the annular grooves in the borehole, depending on which procedure is more favorable production-wise.

The lever can be bolted together with the swivellable component and the cover, in which the lever is supported, can be bolted with the housing. This case of bolting the two components is possible however only if it is assured that the bearing point of the lever in the cover is always coaxial with the very high precision required to the bearing support of swivellable component. Because such a coaxiality cannot always be assured with respect to the production tolerances, it is more favorable if either the cover is flexibly supported—then corresponding flexible seals should also be provided for the subsequent course of the channels—or preferably that the lever is joined with the swivellable component with radial play, e.g., in a pin that engages in a slit in the lever with a slight tangential play.

In the foregoing general description certain objects, purposes and advantages of this invention have been set out. Other objects, purposes and advantages of this invention will be apparent from a consideration of the following description and the accompanying drawings illustrating one embodiment in which.

Figure 2:
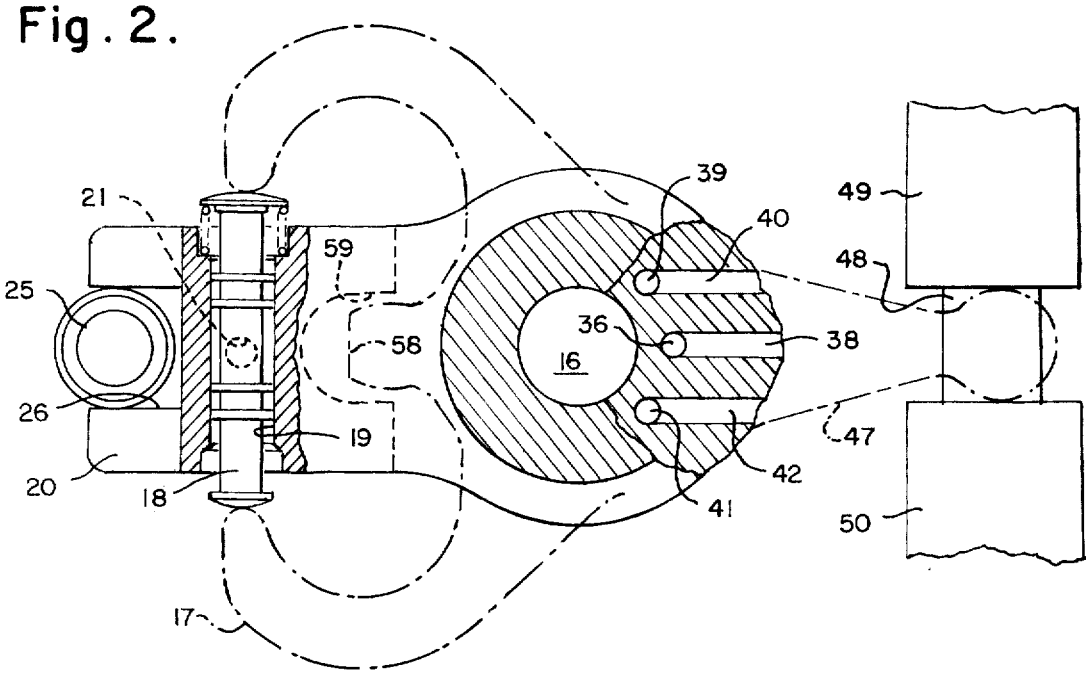
FIG. 2 shows in larger scale a portion of the control device in a view in the direction of the swivel axis.
Figure 3:
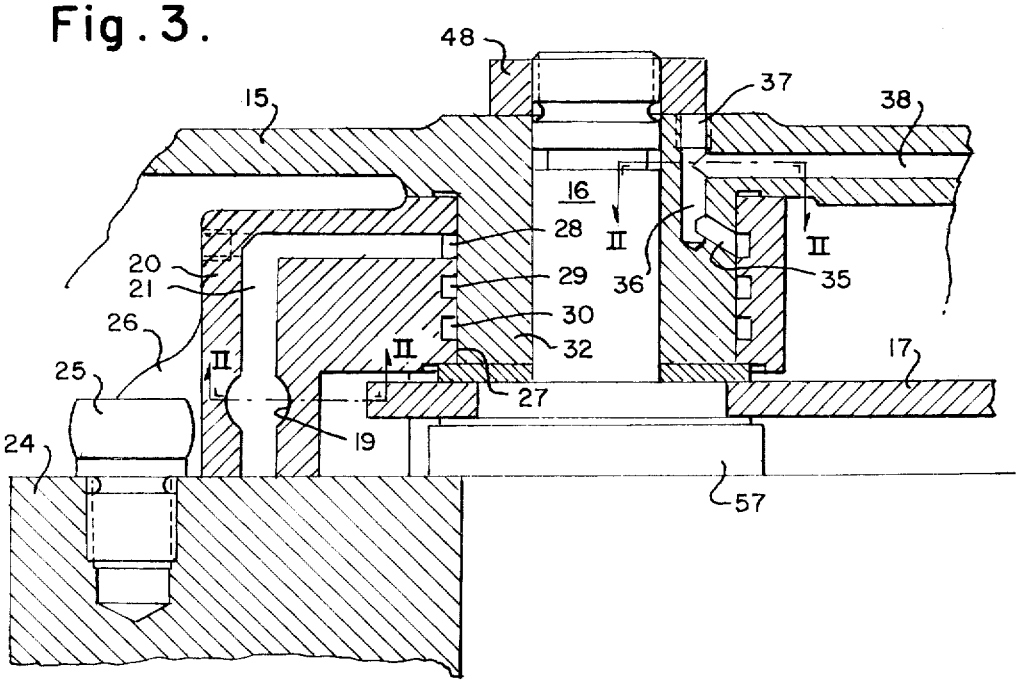
FIG. 3 shows a section through the components shown in FIG. 2, where the swivel axis lies in the sectional plane.
Figure 3A:
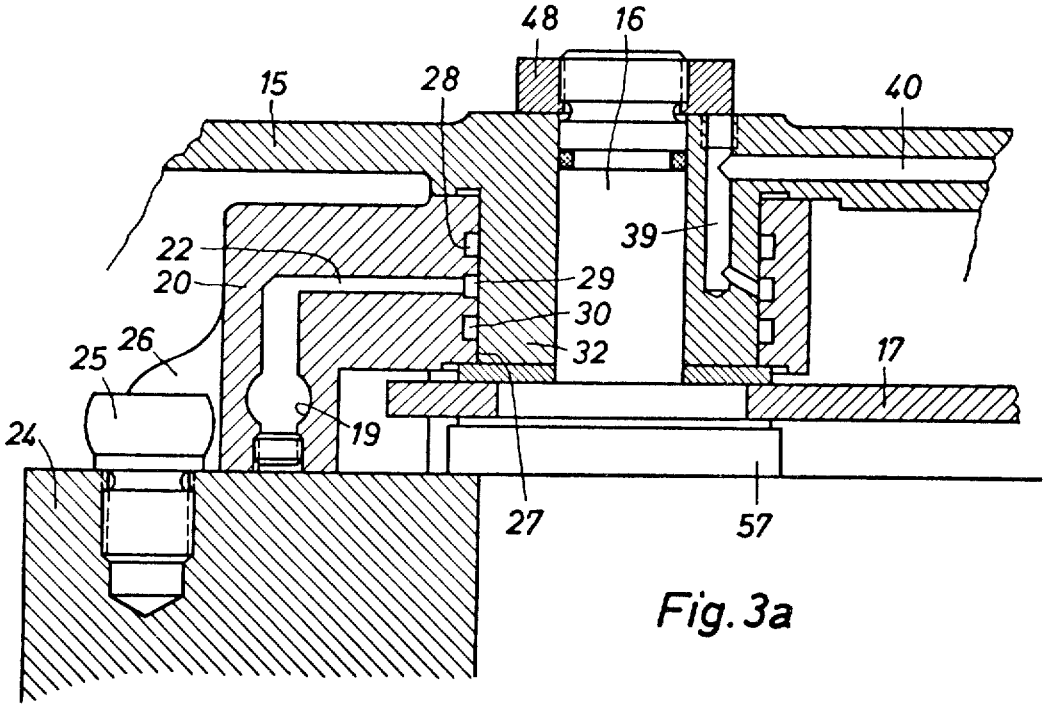

FIG. 3*a* is a section through the assembly of FIG. 2 on a line parallel to the section of FIG. 3 but through boreholes 40 and 22.

Figure 3B:
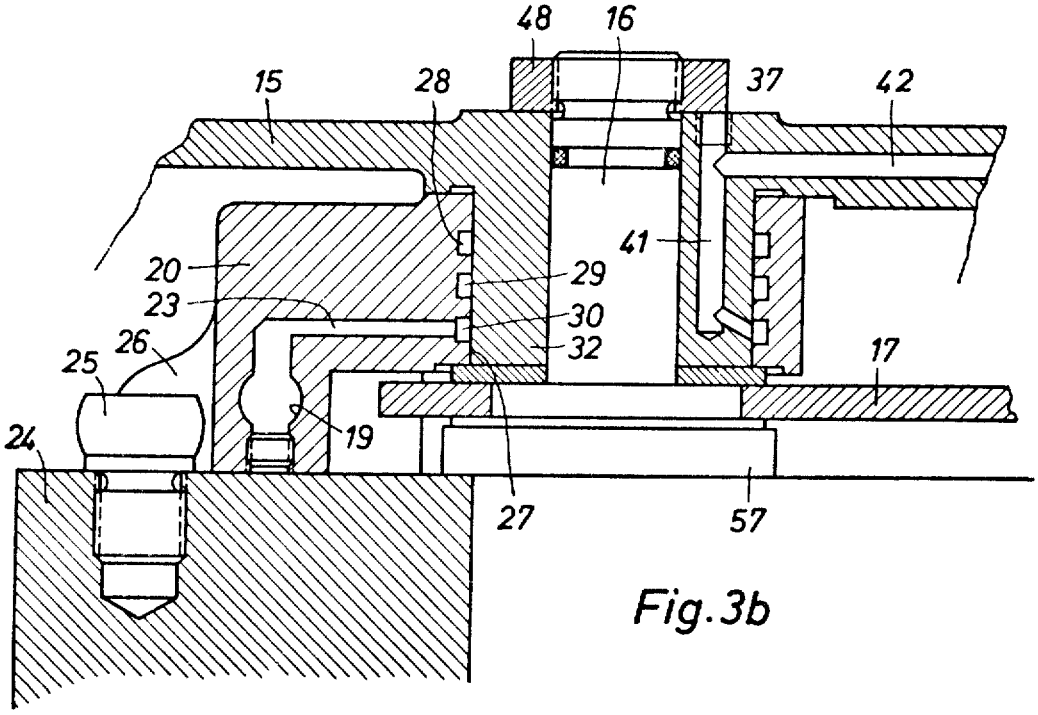
Figure 4:
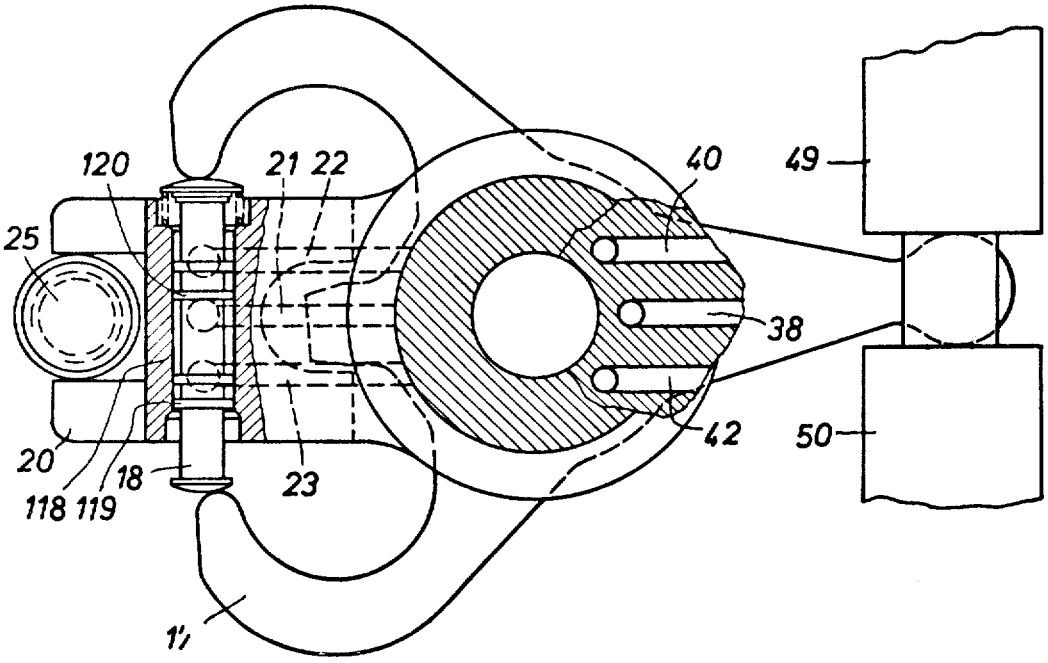
Figure 5:
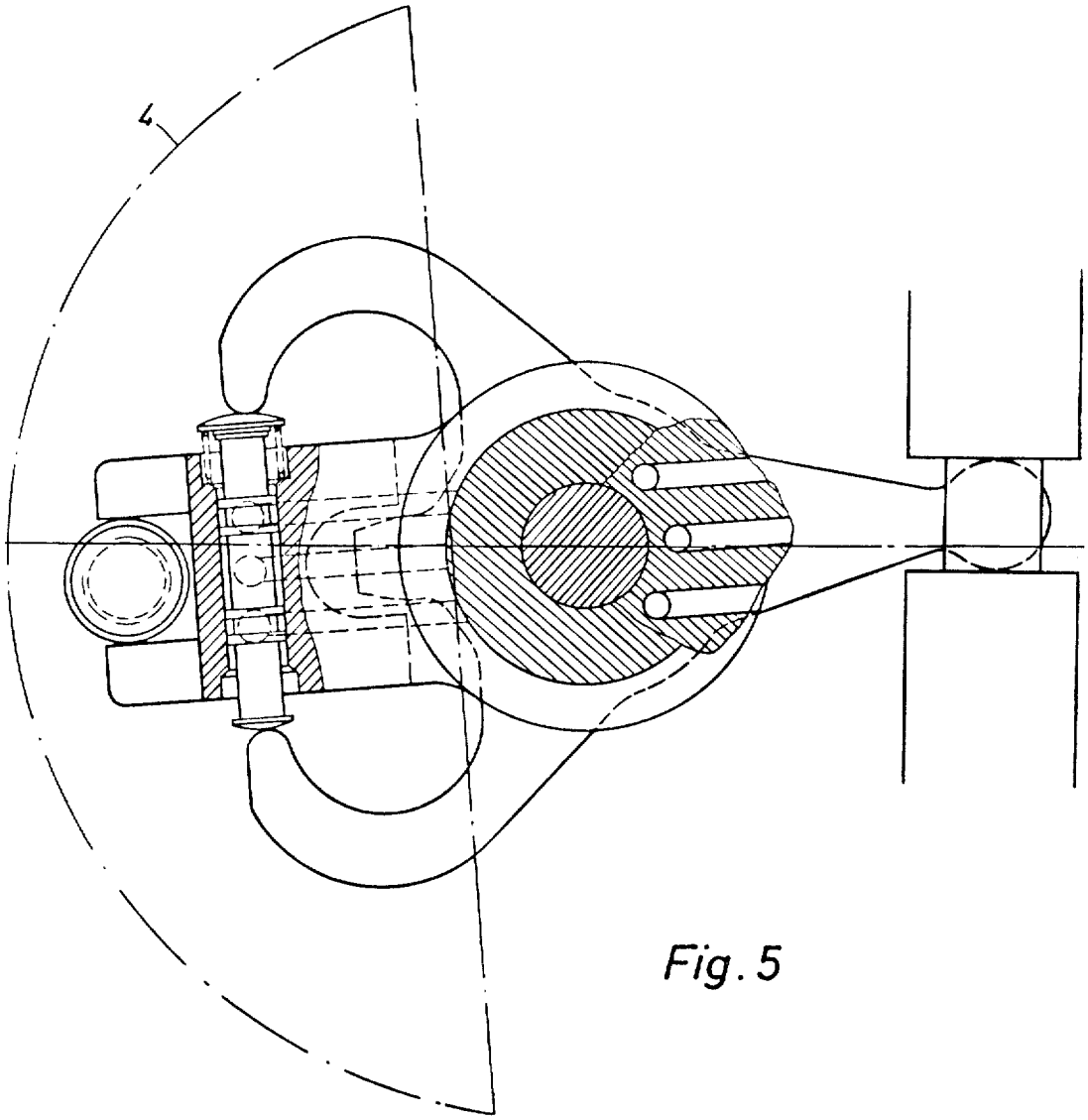

FIG. 3*b* is a section through FIG. 2 on a line parallel to the section of FIG. 3 but through boreholes 23 and 42;

FIG. 4 is a portion of the control device illustrated in FIG. 2 with positions of parts changed as a result of the control function; and FIG. 5 is a portion of the control device illustrated in FIG. 2 with positions of parts changed as a result of the control function.

Figure 1:
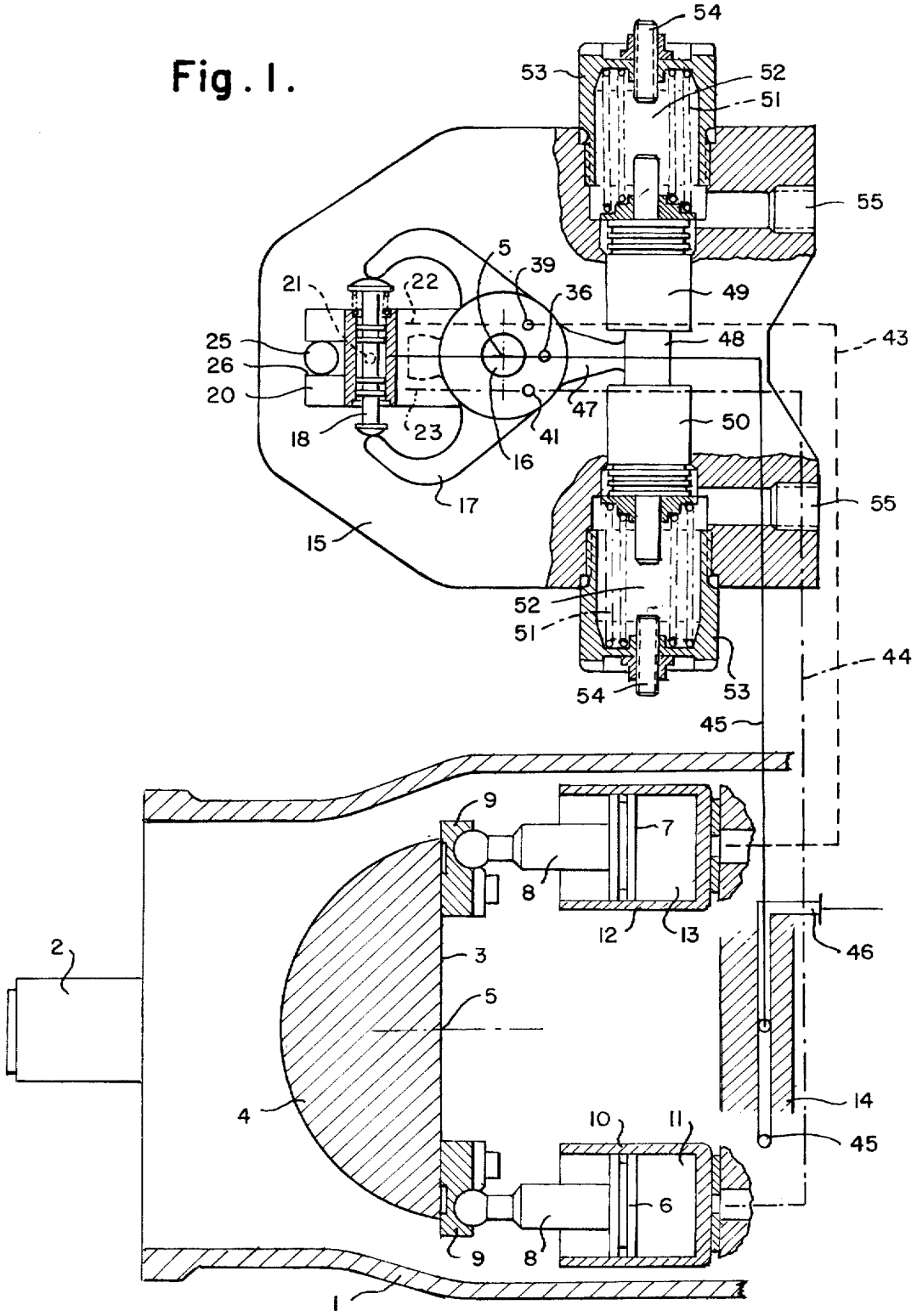
FIG. 1 shows a section through a tapered washer pump according to this invention in the lower portion and the raised cover of it in the upper portion.

Referring to the drawings, there is in FIG. 1 illustrated a shaft 2 supported in the housing 1. A cylindrical drum (not shown in the drawing but conventional swash plate pump design) is supported on this shaft 2. Pistons (not shown in the drawing, also of conventional swash plate pump design) extend out from the cylindrical drum and they rest against a tapered swash plate 3, which is formed on a semicylindrical body 4, which is supported in the housing 1 so as to be rotatable around the swivel axis 5 in conventional manner not shown in the drawing. For the purpose of swivelling the semicylindrical body 4 around the swivel axis 5, two control pistons 6 and 7 are provided and they are connected through a piston rod 8 and a support component 9 with the semicylindrical body 4. The control piston 6 is capable of moving in a control cylinder 10, in which a pressure chamber 11 is formed and control piston 7 is capable of moving in a control cylinder 12, in which a pressure chamber 13 is formed.

The housing 1 is closed off by a bottom section 14 toward the front end.

An opening in the housing 1, lying in front of the sectional plane of the lower portion of FIG. 1 in the direction of view, is closed off by a cover 15. The upper portion of FIG. 1 shows a view into the inside of this cover, which is thus swung up by 180° in the upper portion of FIG. 1, such that the swivel axis 5 again lies precisely in the direction of view. A bearing bolt 16 is supported in the cover 15. A control lever 17, whose forks lie with a slight play against the end faces of a valve piston 18 that constitutes the final control element, is swivellably supported on this bearing bolt 16. The valve piston 18 is inserted in a borehole 19 of the lever 20, in which case three channels 21, 22, and 23 empty into this borehole 19. These channels, together with the annular grooves on the valve piston 18, form the square regulation.

A carrier bolt 25 is fastened to the swivellable section 24 of the tapered swash plate pump and its head lies with a slight play against the walls 26 of a slit that is formed in the lever 20 radial to the swivel axis 5.

The lever 17 is supported on the eccentric portion 57 of the bearing bolt 16.

The lever 20 has a cylindrical borehole 27 in which three annular grooves are formed, of which the annular groove 28 is in operating connection with channel 21, annular groove 29 with channel 22, and annular groove 30 with channel 23.

The lever 20 is supported with the borehole 27 on an external cylindrical extension 32 of the cover 15. A borehole 35 is formed in this extension 32. It passes over into a borehole 36 that is closed off by a stopper 37 and to which a borehole 38 connects, where the mouth of the borehole 35 lies in front of the annular groove 28. A borehole 39 lies parallel to the borehole 36 and empties into a borehole 40 and is also in operating connection with a borehole whose mouth lies in front of the annular groove 29. A borehole 41 is also provided in the extension 32, parallel to these two boreholes 36 and 39, and it is connected with an outlet borehole whose mouth lies in front of the annular groove 30 and which is also connected with a borehole 42 in the cover 15. The borehole 40 is connected with the pressure chamber 13 through a line 43 and the borehole 42 is connected with the pressure chamber 11 through a line 44, while the borehole 38 is in operating connection through a line 45 with a channel 46, which is connected with the control pressure pump.

The rear section 47 of the control lever 17 is connected with a control component 48, on which two control pistons 49 and 50 or a control piston that can be loaded from both sides 49, 50 are formed; the latter pistons are capable of displacement in the corresponding control cylinder boreholes and each of them rests against a set of springs of different length 51, which are located in a control pressure chamber 52, which is closed off by a cap 53 and in which a final stop pin 54 is located. Each of these two pressure chamber 52 is connected through a bored line 55 with a control pressure arrangement (not shown in the drawing), through which one of the two control pressure chambers 52 is arbitrarily loaded with operating pressure and the other is connected with a pressureless drain.

The mode of operation is as follows: By arbitrarily loading one of the pressure chambers 52 with operating pressure through one of the lines 55, one of the control pistons 49 or 50 or one side of the control piston 49, 50 is loaded and thus the lever component 47 is swung in one or the other direction around the swivel axis 5. During such a swivelling the lever 17 carries the valve piston 18 with the result that during swivelling in one direction the borehole 21 is connected with the borehole 22 and when swivelled in the other direction the borehole 21 is connected with the borehole 23. This means that with a swivelling in one direction the annular groove 28 is connected with the annular groove 29 and with a swivelling in the other direction the annular groove 28 is connected with the annular groove 30. The control pressure medium that is produced by the control pressure pump flows through the bored line 46 and the line 45 and the boreholes 38 and 35 into the annular groove 28.

When the lever 17 is swung in one direction, the pressure medium thus flows from the borehole 38 through the annular groove 28, the borehole 21, the borehole 22, and the annular groove 29 to the borehole 40 and from it through the line 43 into the pressure chamber 13, with the result that the semicylindrical body 4 is swung around the swivel axis 5 in the counterclockwise direction. Here it takes the lever 20 through the bolt 25 and one of the walls 26 of the slit, such that the valve piston 18 is displaced so far relative to the borehole 19 with the lever 17 now in a stationary position that the mouth of the borehole 21 is closed off by the valve piston 18 if the position of the semicylindrical body 4 is followed by the position of the lever 17.

The eccentric bolt 16 is fixed in the cover 15 by a nut 48.

The lever 17 has an extension 58 that engages in a recess 59 of the lever 20 with considerable play, in order to facilitate a mechanical entrainment in the absence of pressure medium.

FIGS. 4 and 5 depict the same components illustrated in FIG. 2 but in positions changed relatively to one another as a result of the control function movements. In these figures, the central annular groove in the pilot piston is designated by the numeral 118 in FIG. 4. This central groove is limited by an edge part 119 on one side and on the other side by an edge part 120.

In the position shown in FIG. 4 the control pistons 49 and 50 have been displaced upward somewhat as compared with the position shown in FIG. 2, with the result that the forked lever 117 is swung counterclockwise. Because the lever 20 has not followed this swinging movement, it has the result that the pilot piston 18 is shifted downward in the drawing in its borehole 19. The annular groove 118 on the pilot piston 18 thus connects the mouth of the borehole 21 with the mouth of the borehole 23, that is, so that the pressure medium flowing in through the boreholes 38, 36 and 35, the annular groove 28, and the borehole 21 flows through the borehole 23 via the annular groove 30 and the boreholes 41 and 42 through the channel 44 in the operating cylinder 12, so that the control piston 7 is displaced to the left in the drawing of FIG. 1 and as a result the rocker 4 swings counterclockwise, i.e., in the same direction as the lever 17. Because the rocker 4 carries with it the lever 20 through the lug 25, the component in which the borehole 19 and the boreholes 21, 22 and 23 are located is now also swung counterclockwise until the original position is reached, in which only the mouth of the borehole 21 dips into the annular groove 118, while the mouth of the borehole 23 is closed off by the edge section 119 and the mouth of the borehole 22 is closed off by the edge section 120.

The mouth of the borehole 21, through which the pressure medium is fed in, is thus again shut off and has found a new rest position in which the positions of the lever 17, the rocker 4, and the lever 20 correspond. This rest position is shown in FIG. 5.

In the foregoing specification certain preferred practices and embodiments of this invention have been set out, however, it will be understood that this invention may be otherwise embodied with the scope of the following claims.

We claim:

1. In an adjustable axial flow piston pump bearing a housing, a swivellable component in said housing, pressure medium loaded operating pressure chambers in said housing for swivelling the swivellable component, said chambers being capable of being loaded through a follow-up control arrangement having first and second control levers movable relatively to one another and supported on a common swivel axis with said swivellable component, said second control lever supported in a swivellable manner coaxially to the swivellable component, opposed control arms on one end of said second lever in operating connection with opposite ends of a final control valve means of the pressure medium-loaded pressure chambers, said final control valve means being supported in said first control lever that is swivellable in common with the swivellable component and with the final control valve means forming an edge control of the follow-up control arrangement, the improvement comprising said first lever connected with the swivellable component and supported in a section of the housing, said final control valve means mounted in and movable in said first lever, fluid passage means in said first lever supplying fluid pressure medium to the final control valve means, fluid passage means in said housing connected to said pressure medium loaded operating chambers and fluid passages means in said first lever connecting said final control valve means and the fluid passages in said housing whereby fluid pressure medium is delivered through the first lever and final control valve means to at least one of said pressure medium loaded operating chambers.

2. An adjustable axial flow piston pump as claimed in claim 1 wherein the swivellable component is a swivellable swash plate.

3. An adjustable axial flow pump as claimed in claim 1 wherein the pressure medium-loaded operating chambers are operating cylinders of a servo control device.

4. An adjustable axial flow pump as claimed in claim 1 wherein the final control valve means is a valve spool movable axially in a bore in said lever.

5. An adjustable axial flow pump as claimed in claim 1 or 2 or 3 or 4, wherein the housing section in which the lever is supported is a cover member.

6. An adjustable axial flow pump as claimed in claim 1 or 2 or 3 or 4, wherein the lever is supported in a housing section in which there are at least three channels, one of which is connected with a control-pressure pump and at least two of which are each connnected with a pressure chamber.

7. Axial flow piston pump as claimed in claim 1 or 2, or 3 or 4, characterized in that the support of the lever is designed as a rotary transmission for several pressure-fluid channels.

8. Axial flow piston pump as claimed in claim 7, characterized in that the lever has a borehole that is supported on a cylindrical extension of the housing section and, with the latter, forms the rotary transmission.

9. Axial flow piston pump as claimed in claim 8, characterized in that a bearing bolt, on which the control lever connected to the final control valve means is supported, projects through the cylindrical extension.

10. Axial flow piston machine according to claim 9, characterized in that the bearing bolt is eccentric and is arbitrarily rotatable for the purpose of adjusting the position of the control lever connected with the final control valve means.

11. An axial flow piston pump of the swash plate type having fluid pressure operated pressure chambers acting on the swash plate to cause it to swivel about an axis comprising a housing carrying said pump, a swash plate pivoted on an axis of rotation in said housing, fluid pressure operated pressure chambers in said housing acting on opposite sides of said swash plate to cause it to swivel, first and second control levers on a common swivel axis on said housing coaxial with the axis of rotation of the swash plate, fluid control valve means mounted in one end of said first lever, a bore in the opposite end of said first lever coaxial with the axis of rotation of the swash plate, said second control lever having a depending flange intermediate its ends fitting within the bore of said first lever, opposed control arms on one end of said second lever acting on opposite ends of said fluid control valve means in the first lever, a first fluid passage in said first lever connecting the bore with the fluid control valve means, at least two additional fluid passages in said first lever connecting the bore with the fluid control valve means, connections in the housing connecting said at least two passages in the first control lever with the fluid pressure operated chambers, at least one fluid supply passage in the housing connecting through the depending flange with said first passage in the bore, at least two bores in the depending flange connecting said at least two passages in the first lever with the said at least two passages in the housing and fluid power means on said housing acting on the other end of said second lever to control movement of the fluid control valve means in the first lever.

12. An axial flow pump as claimed in claim 11 wherein the fluid pressure operated chambers are fluid operated pistons in cylinders in the housing.

* * * * *